US006780045B2

(12) United States Patent
Shuey et al.

(10) Patent No.: US 6,780,045 B2
(45) Date of Patent: Aug. 24, 2004

(54) CONNECTOR POSITION ASSURANCE DEVICE

(75) Inventors: John R. Shuey, Mechanicsburg, PA (US); John Wesley Hall, Jr., Harrisburg, PA (US); John Mark Myer, Millersville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/091,898

(22) Filed: Mar. 6, 2002

(65) Prior Publication Data

US 2003/0171027 A1 Sep. 11, 2003

(51) Int. Cl.[7] ..... H01R 3/00
(52) U.S. Cl. ..... 439/489; 439/352
(58) Field of Search ..... 439/489, 352, 439/358, 350, 353, 357

(56) References Cited

U.S. PATENT DOCUMENTS

| | | | | |
|---|---|---|---|---|
| 5,928,038 A | | 7/1999 | Berg et al. | 439/752 |
| 5,947,763 A | * | 9/1999 | Alaksin | 439/489 |
| 6,045,388 A | * | 4/2000 | Higgins et al. | 439/352 |
| 6,068,507 A | | 5/2000 | Popa | 439/489 |
| 6,077,101 A | | 6/2000 | Garretson et al. | 439/352 |
| 6,261,116 B1 | | 7/2001 | Ceru | 439/352 |
| 6,406,319 B2 | * | 6/2002 | Pederson et al. | 439/352 |
| 6,435,895 B1 | * | 8/2002 | Fink et al. | 439/352 |

FOREIGN PATENT DOCUMENTS

| | | | |
|---|---|---|---|
| EP | 0 721 234 A2 | 7/1996 | H01R/13/08 |
| EP | 0 848 456 A2 | 6/1998 | H01R/13/436 |
| EP | 1 096 616 A2 | 5/2001 | H01R/13/629 |

* cited by examiner

*Primary Examiner*—Alex Gilman

(57) ABSTRACT

An electrical connector assembly is provided including a CPA, a first connector housing, a second connector housing, a retention assembly, a second retention feature, and a CPA mounting assembly. The CPA includes a retention assembly locking element and a CPA retention element. A retention assembly is mounted to the first connector housing to maintain the first and second connector housings in contact when they are mated. The retention assembly includes a first retention feature, a CPA retention feature, and a locking contact surface, and is movable between a locked and unlocked position. The first connector housing also has a CPA mounting assembly mounted thereto. The CPA is slidably mounted to the CPA mounting assembly and is movable to first and second positions. In its first position, the CPA permits engagement of the first and second connector housings. In its second position, the CPA prevents engagement and disengagement of the first and second connector housings.

15 Claims, 8 Drawing Sheets

CONNECTOR POSITION ASSURANCE DEVICE

BACKGROUND OF THE INVENTION

Certain embodiments of the present invention generally relate to a connector position assurance device (CPA) for use with electrical connector housings, and an electrical connector system having a connector position assurance device.

Electrical connectors have been proposed that utilize a latch or retention assembly to maintain connector halves in a fully mated position, along with a CPA. When the connector halves are mated and the latch or retention assembly is positioned to maintain contact between the connector halves, the CPA is moved to a position that indicates the connector halves are properly connected. Thus, the CPA provides a means to assure that the connector halves are fully mated.

It is advantageous to add the use of a CPA to an existing connector half that was originally designed for use without a CPA. Conventional connector assemblies utilizing CPAs, however, feature connector halves that were both designed for use with CPAs, so conventional connector halves utilizing CPAs cannot conveniently be retrofitted to mate with existing connector halves. Additionally, it is desirable to have an interchangeable connector half that may be used interchangeably with both a mating connector half in a connector assembly utilizing a CPA and a different mating connector half in a connector assembly without a CPA, wherein the interchangeable connector half is manufactured as simply and economically as possible.

Also, conventional connector assemblies using CPAs and latches can suffer from other drawbacks. For example, the CPA may inadvertently advance to a position indicating the connector halves are mated when the connector halves are separated. The CPA may also not be secured in position when the connector halves are mated.

A connector is needed with an improved CPA and connector half configuration that overcomes the above-noted and other disadvantages of conventional connectors.

BRIEF SUMMARY OF THE INVENTION

At least one embodiment of the present invention is provided including an electrical connector assembly comprising a connector position assurance device (CPA), a first connector housing, a second connector housing, a retention assembly, a second retention feature, and a CPA mounting assembly. The CPA includes a retention assembly locking element and a CPA retention element. One of the first and second connector housings has a body section with a mating interface on one end, and the other connector housing has an opening to receive the mating interface. A retention assembly is mounted to the first connector housing to maintain the first and second connector housings in contact when they are mated. The retention assembly includes a first housing retention feature, a CPA retention feature, and a locking contact surface. The retention assembly is movable between locked and unlocked positions. A second housing retention feature is mounted to the second connector housing. The second housing retention feature cooperates with the first housing retention feature to maintain contact between the first and second connector housing when they are mated.

The first connector housing has a CPA mounting assembly mounted thereto. The CPA is slidably mounted to the CPA mounting assembly and is movable to first and second positions. In its first position, the CPA permits biasing of the retention assembly and engagement and disengagement of the first and second connector housings. When the CPA is in the second position, the retention assembly locking element cooperates with the locking contact surface to prevent the retention assembly from moving to the unlocked position, thus preventing engagement and disengagement of the first and second connector housings. The CPA retention element cooperates with the CPA retention feature to maintain the CPA in the second position.

Additionally, the CPA may include a first CPA beam and at least one second CPA beam, and the retention assembly may include arms and a cross-member joining the arms. The first CPA beam includes the CPA retention element, and the second CPA beam includes the retention assembly locking element. The arms include the locking contact surface, and the cross-member includes the CPA retention feature. Optionally, the retention assembly may include a retention member with first and second retention member surfaces. The first retention member surface includes the first retention feature. The second retention member surface includes the CPA retention feature.

At least one embodiment of the present invention provides an electrical connector comprising a CPA, a plug housing, a header housing, a latch assembly, a latch retention assembly, and a CPA mounting assembly. The CPA includes a latch locking element and a CPA retention element. The plug housing has a body section with a mating interface on one end, and the header housing includes walls defining an opening to receive the mating interface.

A latch assembly is mounted to the plug housing for maintaining the housings in contact when mated. The latch assembly includes a retention feature, a CPA retention feature, and a locking contact surface. The latch assembly is movable between latched and unlatched positions. A latch retention assembly is mounted to the header housing, and includes a latch retention surface. The latch retention surface cooperates with the retention feature to prevent the separation of the plug and header housings when they are mated and the latch is in the latched position.

A CPA mounting assembly is mounted to the plug housing. The CPA is slidably mounted to the CPA mounting assembly and is movable to unmated and mated positions. In the unmated position, the CPA permits deflection of the latch assembly and engagement and disengagement of the plug and header housings. When the CPA is in the mated position, the latch locking element cooperates with the locking contact surface to prevent the latch assembly from moving to the unlatched position, thereby preventing engagement and disengagement of the plug and header housings. The CPA retention element cooperates with the CPA retention feature to maintain the CPA in the mated position.

Optionally, the latch locking element may include a raised surface, and the latch assembly may include an interfering surface and a clearance surface. The interfering surface is substantially parallel to the raised surface when the latch assembly is in the latched position, and the interfering surface contacts the raised surface when the latch assembly is biased toward the unlatched position and the CPA is in the mated position. The clearance surface is sloped relative to the raised surface when the latch assembly is in the latched position, and does not contact the raised surface when the latch assembly is in the unlatched position and the CPA is in the unmated position.

At least one embodiment of the present invention provides an electrical connector half assembly including a CPA and a connector housing. The CPA includes a retention assembly locking element and a CPA retention element. A retention assembly is mounted to the connector housing. The retention assembly includes a housing retention feature, a CPA retention feature, and a locking contact surface. The retention assembly is movable between locked and unlocked positions. A CPA mounting assembly is mounted to the connector housing, and the CPA is slidably mounted to the CPA mounting assembly and movable between first and second positions. The CPA permits biasing of the retention assembly when in the first position. The retention assembly locking element cooperates with the locking contact surface to prevent the retention assembly from moving to the unlocked position when the CPA is in the second position. The CPA retention element cooperates with the CPA retention feature to maintain the CPA in the second position.

Certain embodiments of the present invention thus provide a CPA and connector housing for electrical connectors. The CPA, in addition to providing position assurance, allows a CPA to be used with a connector half not originally designed for use with a CPA. The CPA is prevented from inadvertently advancing to a position indicating the connector halves are mated when the connector halves are separated. The CPA is also secured in position when the connector halves are mated.

Figure 1:
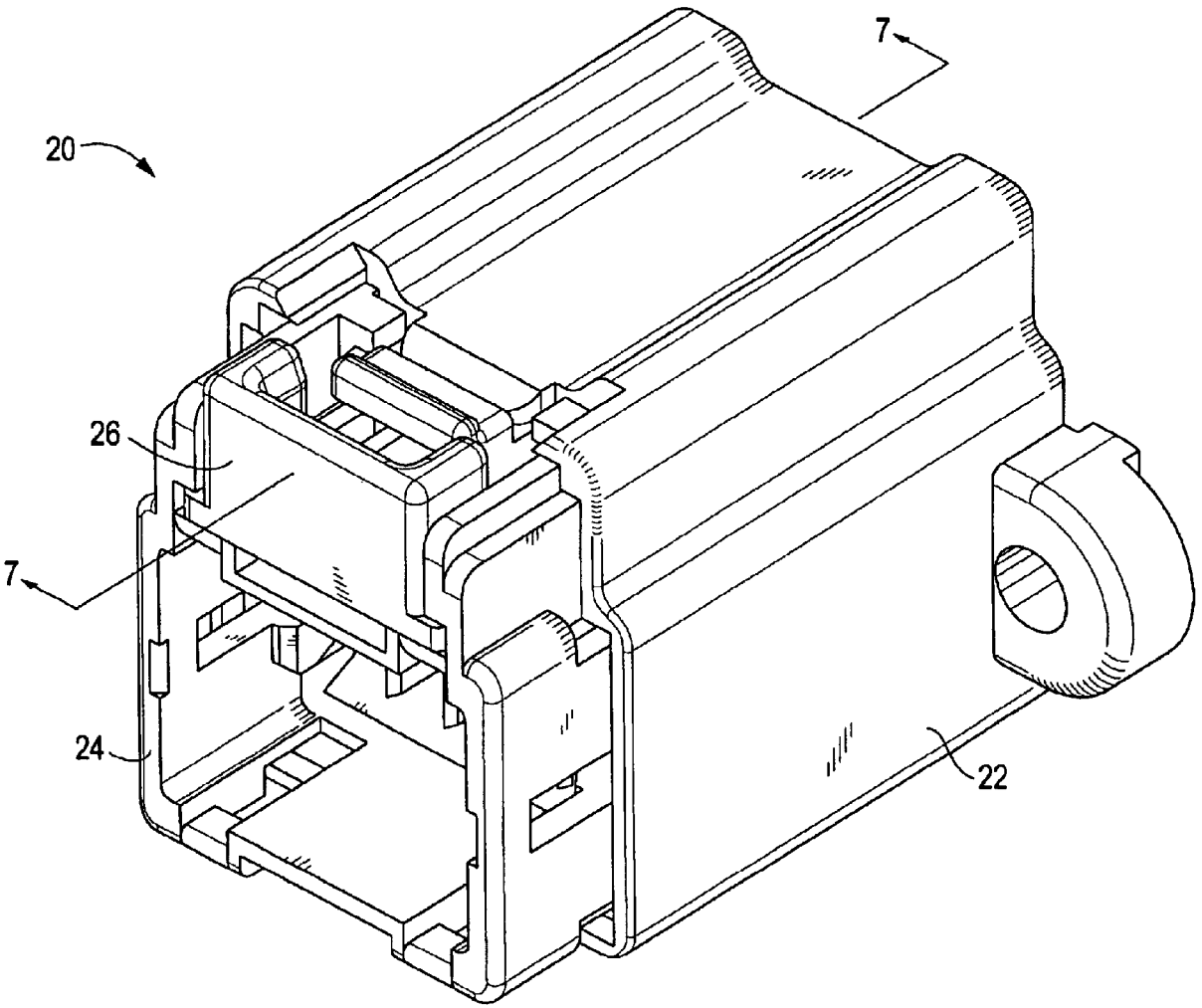
FIG. 1 illustrates an isometric view of a connector assembly with a CPA in the unmated position formed in accordance with an embodiment of the present invention.

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE INVENTION

Figure 2:
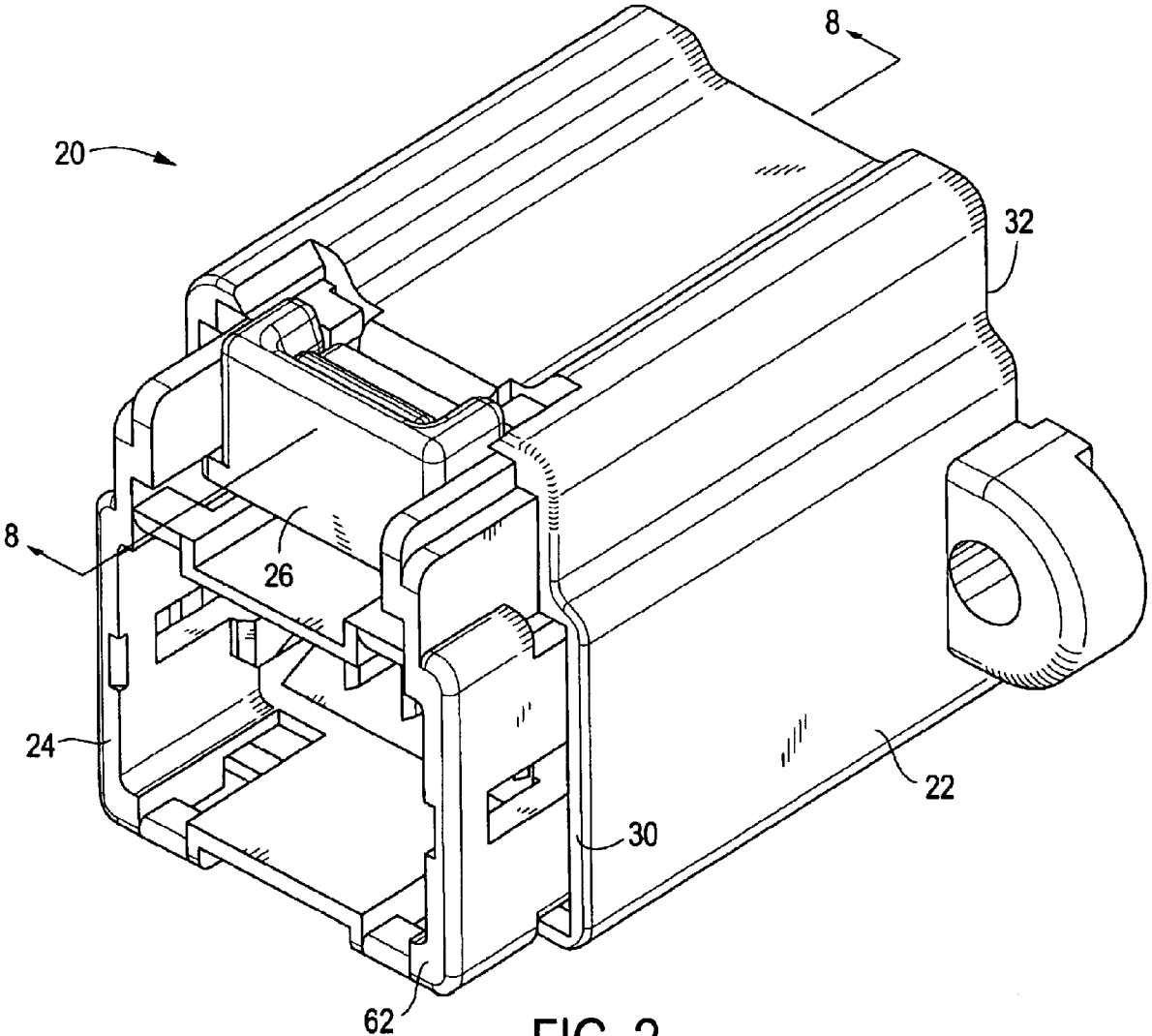
FIG. 2 illustrates an isometric view of a connector assembly with a CPA in the mated position formed in accordance with an embodiment of the present invention.

FIG. 1 illustrates an isometric view of a connector assembly 20. The connector assembly 20 comprises a header housing 22, a plug housing 24, and a connector position assurance device (CPA) 26. In FIG. 1, the header housing 22 and plug housing 24 are shown mated, and the CPA 26 is in the unmated position. FIG. 2 illustrates an isometric view of the connector assembly 20 with the header housing 22 and the plug housing 24 mated, and the CPA 26 in the mated position.

Figure 3:
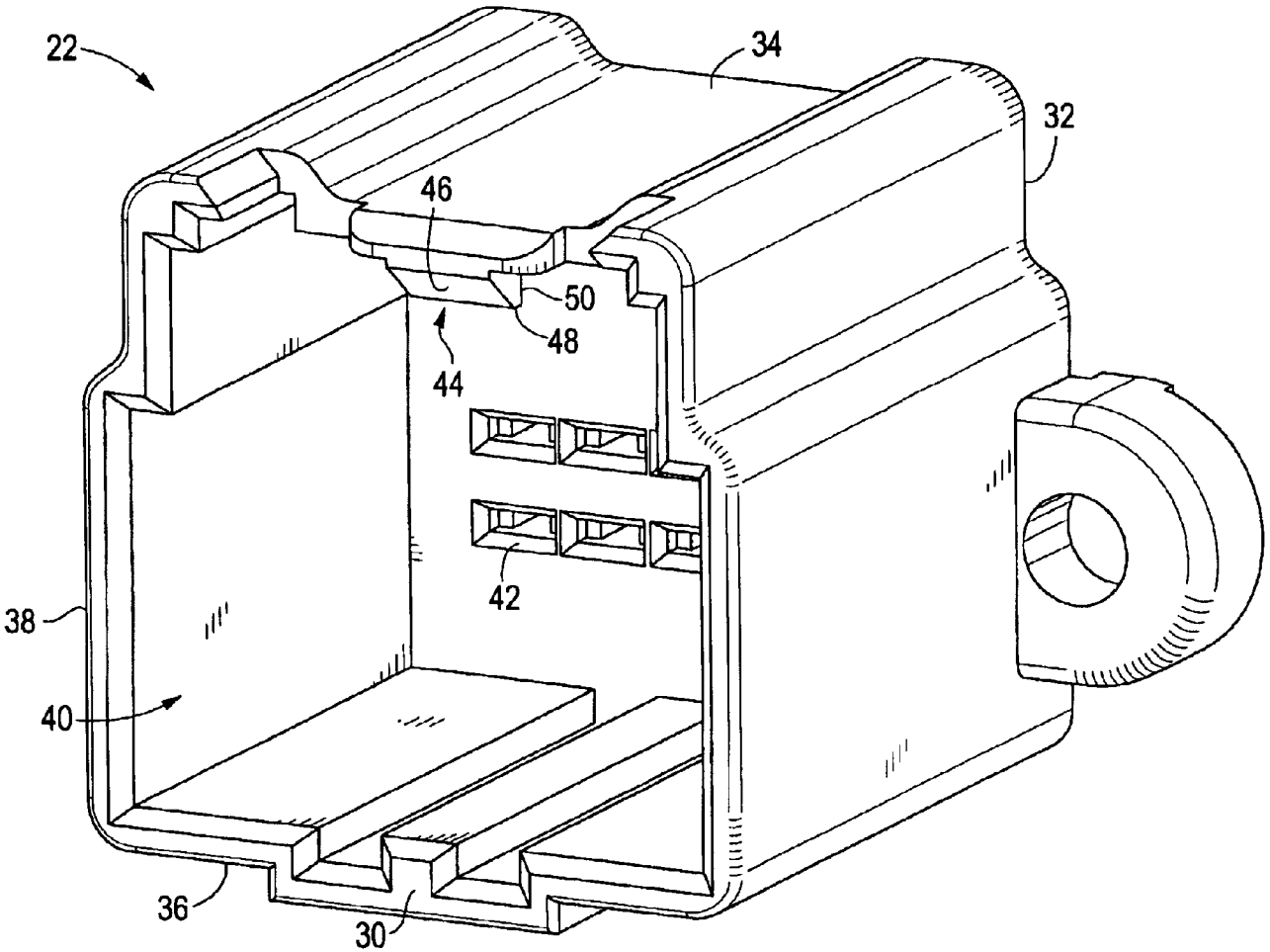
FIG. 3 illustrates an isometric view of a header housing used in accordance with an embodiment of the present invention.

FIG. 3 illustrates an isometric view of the header housing 22. The header housing 22 includes a front end 30, a rear end 32, a top portion 34, a bottom portion 36, and walls 38. The walls 38 join the top portion 34 and the bottom portion 36 with an opening 40 being defined by the interior surfaces of the walls 38 at the front end 30 of the header housing 22. The opening 40 receives the mating interface of the plug housing 24. Towards the rear end 32 of the header housing 22, the opening 40 includes apertures 42 designed to hold pins (not shown) that meet contacts within the plug housing 24 when the header housing 22 and plug housing 24 are mated, providing electrical communication therebetween. A wire harness (not shown) may be connected to the header housing 22 proximal to the rear end 32. The illustrated header housing 22 is an existing model that was designed for use without a CPA.

Further, the header housing 22 includes a latch retention bump 44. The latch retention bump 44 extends downward from the interior top surface of the top portion 34 of the header housing 22 proximal to the front end 30 and comprises a sloped surface 46, a flat surface 48, and a retention surface 50. The sloped surface 46 extends generally downward from the top portion 34 and back toward the rear end 32. The sloped surface 46 terminates at the flat surface 48 leading to the retention surface 50. The retention surface 50 extends downward generally perpendicularly from the top portion 34 and faces the rear end 32.

Figure 4:
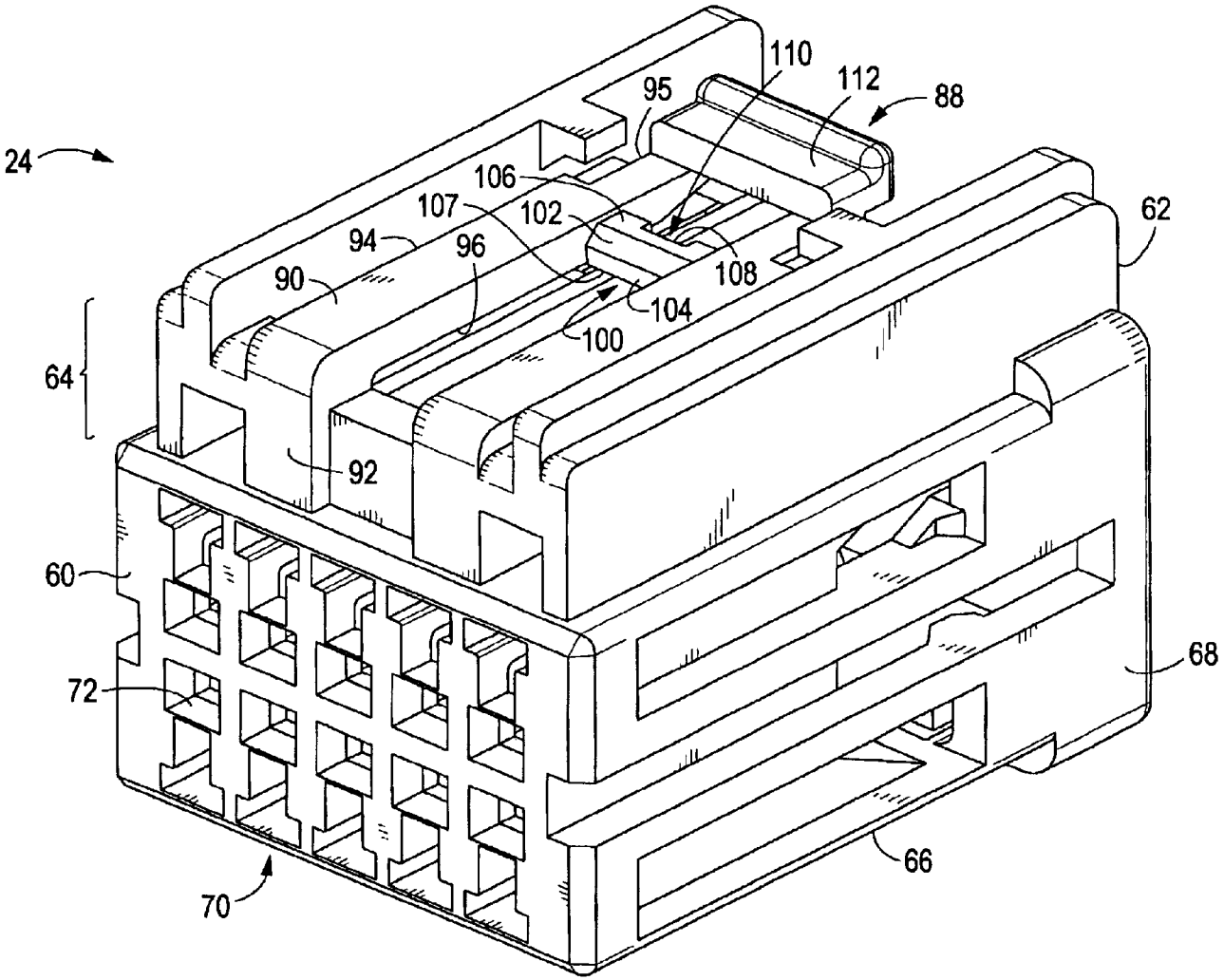
FIG. 4 illustrates a front isometric view of a plug housing formed in accordance with an embodiment of the present invention.
Figure 5:
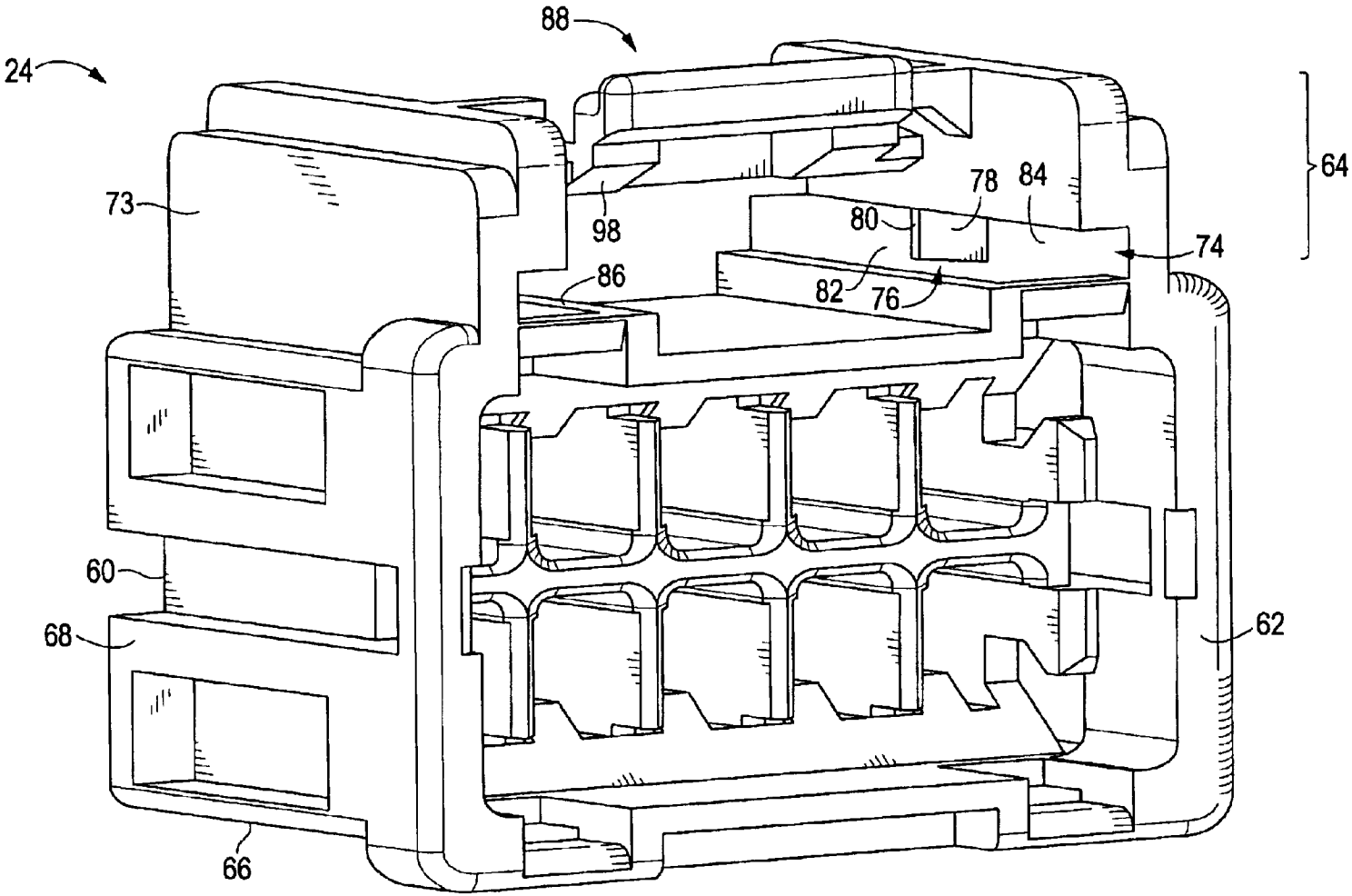
FIG. 5 illustrates a rear isometric view of a plug housing formed in accordance with an embodiment of the present invention.

FIGS. 4 and 5 illustrate isometric views of the plug housing 24. The plug housing 24 includes a front end 60, a rear end 62, a top portion 64, a bottom portion 66, and sides 68. The sides 68 join the top portion 64 and the bottom portion 66. The plug housing 24 includes a mating interface 70 proximal to the front end 60. The mating interface 70 includes receptacles 72 that correspond in alignment to the apertures 42 in the rear end 32 of the header housing 22, and hold contacts (not shown) that electrically connect with the pins of the header housing 22 when the header housing 22 and plug housing 24 are mated. A wire harness (not shown) may be mounted proximal to the rear end 62 of the plug housing 24.

As shown in FIG. 5, the top portion 64 of the plug housing 22 includes side rails 73 that include slots 74 facing one another. The slots 74 begin proximal to the rear end 62 of the plug housing 22 and extend into the plug housing 22. The slots 74 include slot protrusions 76, slot sides 84, and shelves 86. The slot sides 84 are located proximal to the interior surface of the sides 68. The slot protrusions 76 extend from the slot sides 84 and each comprise a protrusion sloped surface 78, a protrusion flat surface 80, and a protrusion retaining surface 82. The protrusion sloped surface 78 extends generally away from the slot side 84 and toward the front end 60 of the plug housing 24. The protrusion sloped surface 78 terminates at the protrusion flat surface 80 extending substantially parallel to the slot side 84 and toward the front end 60 of the plug housing 24. The protrusion retaining surface 82 extends substantially perpendicularly away from the slot side 84 and meets the protrusion flat surface 80. The shelves 86 extend substantially perpendicularly from the bottom of the slot sides 84. The slot 74 is sized and configured to accept the CPA 26, and the slot protrusions 76 help maintain the CPA 26 inside the slot 74 after the CPA 26 is mounted in the slot 74.

The plug housing 24 also includes a latch assembly 88. As shown in FIG. 4, the latch assembly 88 includes latch beams 90, a cross-member 100, and a latch finger rest 112. The latch assembly 88 cooperates with the latch retention bump 44 of the header housing 22 to maintain the header housing 22 and the plug housing 24 in contact after they are mated.

The illustrated embodiment of the plug housing 24 includes two latch beams 90 located symmetrically about the central axis of the plug housing 24. The latch beams 90 each comprise a base 92 and an arm 94. The base 92 is located proximal to the front end 60 and the top portion 64. The arm 94 extends away from the base 92 to a latch beam free end 95 located toward the rear end 62 of the plug housing 24. The latch arms 94 may be deflected under an imposed force, the largest deflection being at the latch beam free end 95. Each arm 94 includes a bottom surface 96 and a bottom sloped surface 98. The bottom surface 96 is substantially parallel to the slot 74 (FIG. 5) (when the latch assembly 88 is unbiased) and located nearer to the top portion 64 than the top of the slot 74. Proximal to the latch beam free end 95, the bottom surface 96 terminates, meeting the bottom sloped surface 98. The bottom sloped surface 98 extends toward the latch beam free end 95 and toward the top portion 64 from the bottom surface 96.

As shown in FIG. 4, the cross-member 100 joins the arms 94 at an intermediate position along the length of the arms 94. The cross-member 100 includes a first sloped surface 102, a second sloped surface 104, a top surface 106, a bottom surface 107, and a retention surface 108. The first sloped surface 102 slopes toward the top portion 66 and the rear end 62 of the plug housing 24, and is used to facilitate biasing of the latch assembly 88 during mating by cooperating with the sloped surface 46 of the latch retention bump 44. The second sloped surface 104 extends toward the bottom portion 66 and the rear end 62 from the point where the first sloped surface 102 and the second sloped surface 104 join. The second sloped surface 104 is used to help maintain the CPA 26 in the mated position. The top surface 104 extends toward the rear end 62 substantially parallel to the bottom surface 96 from the point where the top surface 104 meets the first sloped surface 102. Towards the latch beam free end 95, the retention surface 108 extends from the top surface 106 substantially perpendicular to the top surface 106. The opening 110 extends through the top surface 106 proximal to the retention surface 108. The retention surface 108 cooperates with the retention surface 50 of the latch retention bump 44 (FIG. 3) to maintain the header housing 22 and the plug housing 24 in contact. The bottom surface 107 joins the second sloped surface 104 and the retention surface 108, and is substantially parallel to the top surface 106.

The latch finger rest 112 is mounted to the latch assembly 88 proximate to the latch beam free end 95. The latch finger rest 112 is used to manually bias the latch assembly 88 to the unlatched position to facilitate engagement and disengagement of the header housing 22 and the plug housing 24. Locating the latch finger rest 112 at the latch beam free end 95 provides the greatest mechanical advantage for deflecting the latch beams 90 about bases 92.

Figure 6:
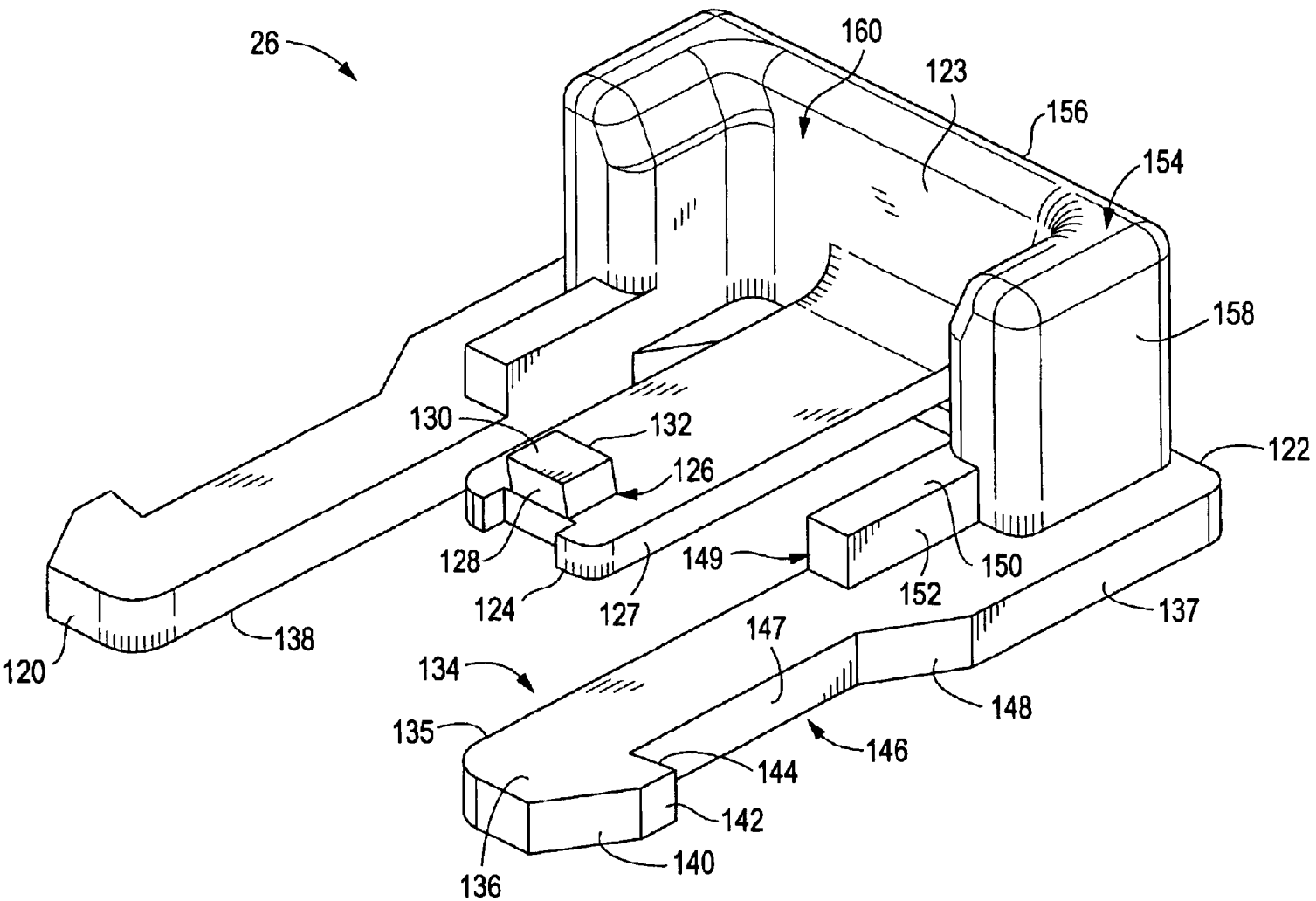
FIG. 6 illustrates an isometric view of a CPA formed in accordance with an embodiment of the present invention.

FIG. 6 illustrates an isometric view of the CPA 26. The CPA 26 includes a front end 120 and a back end 122. The CPA further includes a body 123, a center beam 124, side beams 134, and a CPA finger rest 154. The body 123 is located proximal to the back end 122 of the CPA 26. The center beam 124 extends from the body 123 to the center beam free end 127. Proximal to the center beam free end 127, the center beam 124 includes a CPA bump 126. The CPA bump includes a front surface 128, a top surface 130, and a back surface 132. The front surface 128 extends from the top surface of the center beam 124. The top surface 130 is joined to the front surface 128 and extends from the point where it joins the front surface 128 away from the center beam free end 127 substantially parallel to the top surface of the center beam 124. The back surface 132 extends from the top surface 130 towards the top surface of the center beam 124 and at a small angle away from the center beam free end 127.

The side beams 134 extend from the body 123 on either side of the center beam 124 toward their side beam free ends 135. The side beams 134 each include a top surface 136, a side 137, a bottom surface 138, a leading surface 140, a side flat surface 142, a side retention surface 144, a necked-down portion 146, and a pad 149. The top surface 136 and the bottom surface 138 are substantially parallel to each other and joined by the side 137 on the exterior of the CPA 26. The side 137 and the side flat surface 142 are configured to be slidably accepted by the slot 74.

The leading surface 140 of each side beam 134 begins proximate to the side beam free end 135, is substantially perpendicular to the top surface 136 and the bottom surface 138, and extends generally away from the side beam free end 135 and toward the outside of the CPA 26. The leading surface 140 ends at the side flat surface 142. The side flat surface 142 extends from the leading surface 140 away from the side beam free end 135, and is substantially coplanar with the side 137. The side retention surface 144 extends substantially perpendicularly from the side flat surface 142 toward the inside of the CPA 26. The side retention surface 144 cooperates with the slot protrusion 76 to maintain the CPA 26 in the slot 74.

The necked-down portion 146 extends from the side retention surface 144 away from the side beam free end 135. The necked-down portion 146 includes a necked-down side 147 and a necked-down sloped surface 148. The necked-down side 147 extends from the side retention surface 144 substantially parallel to the side until it terminates at the necked-down sloped surface 148. The necked-down sloped surface 148 extends from the necked-down side to join the side 137. The necked-down portion 146 is sized to provide clearance from the slot protrusion 76 when the CPA 26 is moved between the mated and unmated positions.

Each pad 149 includes a pad top surface 150 and pad sides 152. The pad sides 152 extend substantially perpendicularly from the top surface 136 of the side beam 134 to a raised surface, the pad top surface 150. The pad top surface 150 is substantially parallel to the top surface 136 of the side beam 134. The pad 149 cooperates with the bottom surface 96 to prevent the latch assembly 88 from deflecting to the unlatched position when the CPA 26 is in the mated position, thereby maintaining contact between the header housing 22 and the plug housing 24.

The CPA finger rest 154 is located proximal to the back end 122 of the CPA 26 and includes a back 156, sides 158, and a finger rest opening 160. The back 156 and sides 158 together define a "C"-shaped finger rest opening 160. The finger rest opening 160 is sized to accept the latch finger rest 112 when the CPA 26 is moved to the mated position. The CPA finger rest 154 is used by an operator to move the CPA 26 between the mated and unmated positions.

The plug housing 24 includes features required for the use of the CPA 26, and the plug housing 24 and CPA 26 can be used with the existing header housing 22. This allows the connector assembly 20 to utilize a CPA 26 while including the header housing 22 which was originally designed without the CPA 26 in mind. Thus, the plug housing 24 and CPA 26 can be used to upgrade existing header housings to accommodate the use of the CPA 26. This also allows for a single header design to be economically used in both CPA and non-CPA applications.

Sliding the front end 120 of the CPA 26 into the slot 74 proximal to the rear end 62 of the plug housing 24 mounts the CPA 26 in the plug housing 24. The slot sides 84 slidably accept the sides 137 and the side flat surfaces 142 of the CPA 26. As the CPA 26 advances into the slot 74, the leading surface 140 of each side beam 134 encounters the protrusion sloped surface 78 of the slot protrusion 76. The bottom surfaces 138 of the side beams 134 rest on the shelves 86. Further advancement of the CPA 26 causes the leading surface 140 to slide against the protrusion sloped surface 78, thereby biasing the side beam free end 135 inward, away from the slot side 84. As the CPA 26 is still further advanced, the side flat surface 142 of the side beam 134 slides against the protrusion flat surface 80 until the side retention surface 144 is past the protrusion flat surface 80. At this point, the side beam 134 returns to its unbiased orientation, and, if removal of the CPA 26 is attempted, an interference between the side retention surface 144 of the side beam 134 and the protrusion retaining surface 82 prevents removal of the CPA 26 from the plug housing 24.

With the CPA 26 located in the plug housing 24 with the side retention surface 144 just past the protrusion flat surface 80, the front surface 128 of the CPA bump 126 is located slightly more toward the rear end 62 of the plug housing 24 than the retention surface 108 of the cross member 100. This position is the unmated position. An interference between the front surface 128 and the retention surface 108 prevents further advancement of the CPA 26 toward the front end 60 of the plug housing 24 from the mated position. To further advance the CPA 26, the center beam free end 127 of the CPA 26 must be biased so that the front surface 128 can clear the retention surface 108. Thus, the CPA 26 is prevented from inadvertent movement from the unmated position, which would interfere with the mating of the header housing 22 and the plug housing 24.

To mate the header housing 22 and the plug housing 24, the housings are oriented with their respective front ends 30, 60 facing each other, and the housings are then urged toward each other. As the housings are brought together, the mating interface 70 of the plug housing 24 is accepted by the opening 40 of the header housing 22. As the mating interface 70 further enters the opening 40, the first sloped surface 102 of the cross member 100 will encounter the sloped surface 46 of the latch retention bump 44. As the first sloped surface 102 slides against the sloped surface 46, the latch assembly 88 will be biased from its substantially horizontal position as the latch beam free end 95 will be deflected toward the bottom portion 66 of the plug housing 24.

Further urging together of the housings will result in the first sloped surface 102 sliding past the sloped surface 46, and the top surface 106 of the cross-member 100 will contact and slide along the flat surface 48 of the latch retention bump 44. When the latch assembly 88 is biased such that the top surface 106 is as near or nearer to the bottom portion 66 as the flat surface 48 is, the header housing 22 and plug housing 24 may be engaged and disengaged. This is known as the unlatched, or unlocked, position.

Once the top surface 106 has passed the flat surface 48, the latch assembly 88 will return to its original position, and the latch beam 90 will no longer be deflected. This is referred to as the latched, or locked position. With the cross-member 100 now nearer the rear end 32 of the header housing 22 than the latch retention bump 44 is and the latch assembly 88 in the latched position, the retention surface 108 of the cross-member 100 and the retention surface 50 of the latch retention bump 44 now face each other and cooperate to form an interference preventing separation of the header housing 22 and the plug housing 24.

Simultaneous to the unbiasing of the latch assembly 88 as the top surface 106 and flat surface 48 pass each other, the flat surface 48 of the latch retention bump will contact the top surface 130 of the CPA bump 126. This contact will bias the center beam 124 of the CPA 26 by deflecting the center beam free end 127 down toward the bottom portion 66. The latch retention bump 44, cross-member 100, and CPA bump 126 are configured to allow this deflection to bias the center beam 124 such that the front surface 128 can clear the retention surface 108 and the CPA 26 can be moved from the unmated position.

Figure 7:
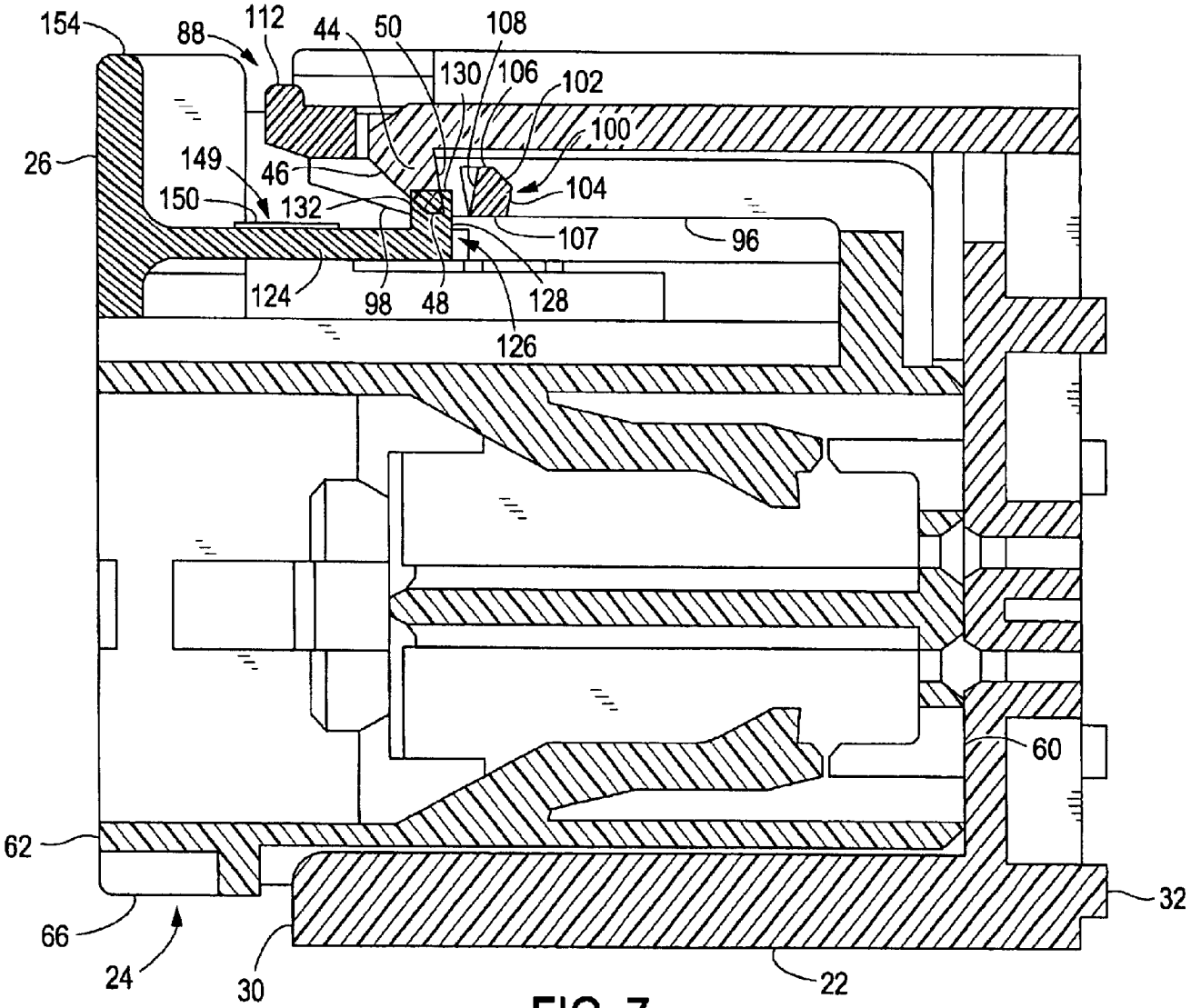
FIG. 7 illustrates a sectional view taken along line 7—7 in FIG. 1 of a mated connector assembly with the CPA in the unmated position in accordance with an embodiment of the present invention.

FIG. 7 illustrates a sectional view taken along line 7—7 of FIG. 1, and shows the header housing 22 mated to the plug housing 24 with the CPA 26 in the unmated position. In FIG. 7, the interference between the latch retention bump 44 and the CPA bump 126 is illustrated; in practice, the center beam free end 127 would be deflected downward toward the bottom portion 66, and the top surface 130 of the CPA bump 126 would be contacting the flat surface 48 of the latch retention bump 44. Thus, as indicated above, the CPA 26 may be advanced toward the rear end 32 of the header housing 22 and into the mated position.

With the CPA 26 in the unmated position as shown in FIG. 7, only the bottom sloped surface 98, and not the bottom surface 96 of the latch beam 90 are immediately above the pad 149. A downward force may be exerted on the latch finger rest 112 to bias the latch assembly 88. As the latch beam 90 is deflected downward, the bottom sloped surface 98 will approach the pad top surface 150, but the latch assembly 88 will enter the unlatched position before the bottom sloped surface 98 and the pad top surface 150 make contact. Thus, the housings may be unmated with the CPA 26 in the unmated position. Further, the pad 149 and bottom sloped surface 98 may be sized so that they contact soon after the latch assembly 88 is past the unlatched position, thereby minimizing any excess, unnecessary deflection of the latch assembly 88 that could result in damage or breakage. To advance the CPA 26 to the mated position, an operator exerts a force on the CPA finger rest 154 urging the CPA toward the rear end 32 of the header housing 22 (put another way, toward the front end 60 of the plug housing 24). As the CPA 26 advances from the unmated position, the top surface 130 of the CPA bump 126 will slide past the flat surface 48 of the latch retention bump 44, and then across the bottom surface 107 of the cross-member 100. Once the CPA 26 has advanced such that the top surface 130 has slid past the bottom surface 107, the center beam 124 will return to its unbiased position, and the CPA 26 will be in the mated position.

Figure 8:
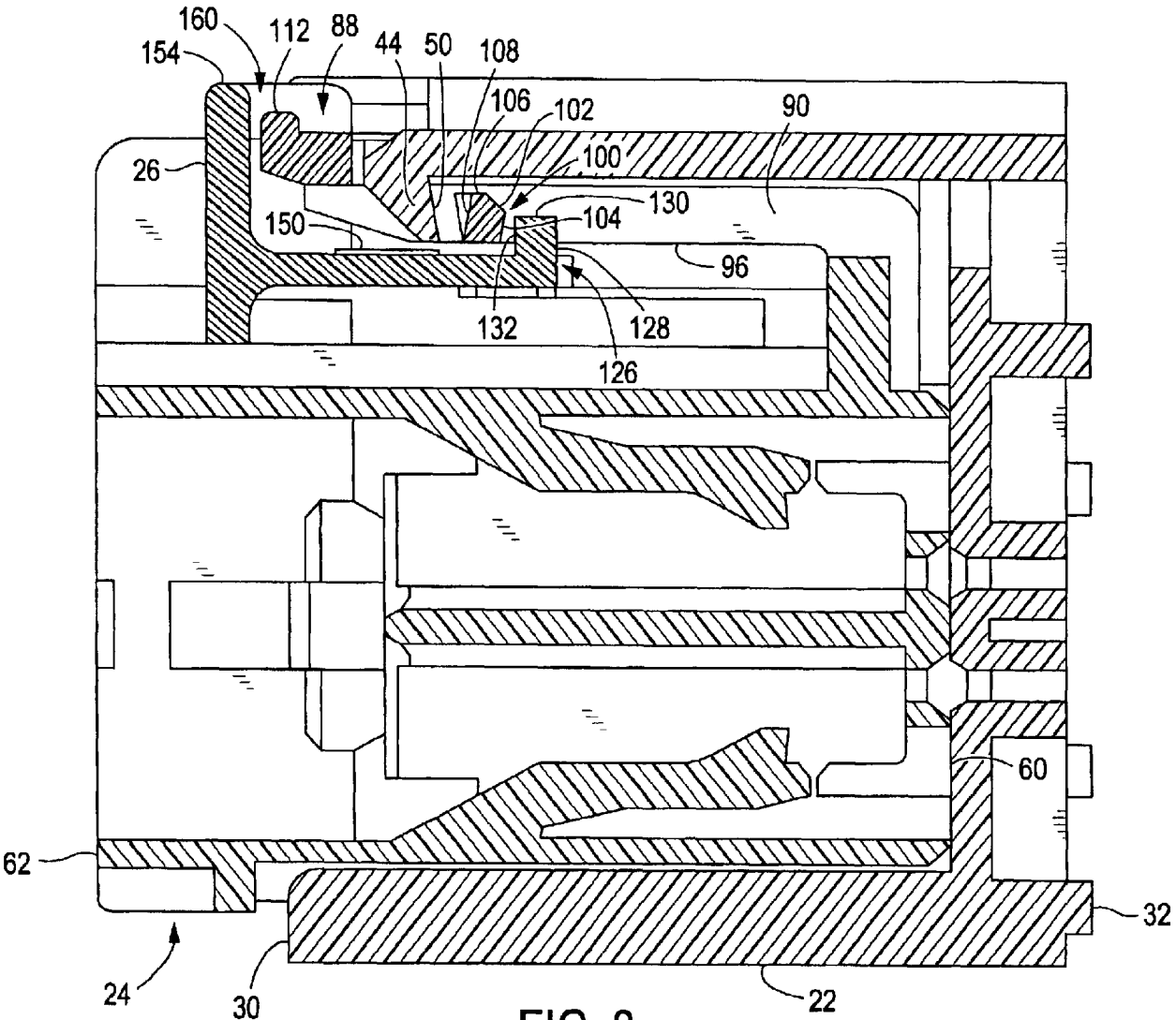
FIG. 8 illustrates a sectional view taken along line 8—8 in FIG. 2 of a mated connector assembly with the CPA in the mated position in accordance with an embodiment of the present invention.

FIG. 8 illustrates a sectional view taken along line 8—8 of FIG. 2, and shows the header housing 22 mated to the plug housing 24 with the CPA 26 advanced to the mated position. With the CPA 26 in the mated position, a portion of the bottom surface 96 of the latch beam 90 is directly above a portion of the pad top surface 150. Thus, if the a downward force is applied to the latch finger rest 112, the bottom surface 96 will approach the pad top surface 150. The bottom surface 96 will contact the pad top surface 150 before the latch assembly 88 has reached the unlatched position. Because the shelves 86 (FIG. 5) support the CPA 26, the contact between the bottom surface 96 and the pad top surface 150 will prevent further biasing of the latch assembly 88. Thus, with the CPA 26 in the mated position, the latch assembly 88 cannot be moved to the unlatched position, and the housings will be maintained in contact. When the CPA 26 is in the mated position, the CPA finger rest opening 160 has advanced to partially surround the latch finger rest 112, making accessing the latch finger rest 112 via a finger or thumb more difficult. Thus, the CPA 26 provides a visual and tactile cue that the housings are mated and the latch assembly 88 cannot be moved to the unlatched position.

If an attempt is made to move the CPA 26 from the mated position of FIG. 8 to the unmated position, the back surface 132 of the CPA bump 126 will encounter the second sloped surface 104 of the cross-member 100. The resulting interference will resist the movement toward the unmated position. This resistance prevents inadvertent movement of the CPA 26 from the mated to the unmated position. The back surface 132 and second sloped surface 104 are configured, however, to provide a slight leading angle such that they may slide against each other if an intentional force is applied by an operator to the CPA finger rest 154, and the CPA 26 may be moved to the unmated position prior to unmating of the housings.

To separate the housings, the CPA 26 is moved to the unmated position, and a downward force is applied to the latch finger rest 112, biasing the latch assembly 88 to the unlatched position. With the CPA 26 in the unmated position and the latch assembly 88 in the unlatched position, the header housing 22 and the plug housing 24 may now be separated.

While particular elements, embodiments and applications of the present invention have been shown and described, it will be understood, of course, that the invention is not limited thereto since modifications may be made by those skilled in the art, particularly in light of the foregoing teachings. For example, the plug and header housings could be reversed, with, for example, the CPA mounted to the header housing. It is therefore contemplated by the appended claims to cover such modifications as incorporate those features which come within the spirit and scope of the invention.

What is claimed is:

1. An electrical connector assembly comprising:

a connector position assurance device (CPA) including a first beam including a retention assembly locking element and a second beam including a CPA retention element;

first and second connector housings, one of said first and second connector housings having a body section with a mating interface on one end thereof and the other of said first and second connector housings having an opening to receive said mating interface;

a retention assembly mounted to said first connector housing for securing said first and second connector housings when said housings are fully mated, said retention assembly including a first housing retention feature, arms, and a cross-member joining said arms, said cross-member including a CPA retention feature, and said arms including a locking contact surface, said retention assembly being movable between locked and unlocked positions;

a second housing retention feature mounted to said second connector housing, said second housing retention feature cooperating with said first housing retention feature to secure said first and second connector housings when said housings are fully mated; and a CPA mounting assembly mounted to said first connector housing, said CPA being slidably mounted to said CPA mounting assembly and movable between first and second positions, said CPA permitting biasing of said retention assembly and engagement and disengagement of said first and second connector housings when in said first position, said retention assembly locking element underlying said locking contact surface to prevent said retention assembly from moving to said unlocked position when said CPA is in said second position, whereby said CPA prevents engagement and disengagement of said first and second connector housings when in said second position, said CPA retention element cooperating with said CPA retention feature to maintain said CPA in said second position.

2. The electrical connector assembly of claim 1 wherein said retention assembly locking element includes a raised surface, said retention assembly locking element extending from said CPA to a raised surface, and said retention assembly includes first and second surfaces, said first surface including said locking contact surface, said first surface being located proximal to said raised surface when said CPA is in said second position and contacting said raised surface when said retention assembly is biased toward said unlocked position when said CPA is in said second position, said second surface being located proximal to said raised surface when said CPA is in said first position and not contacting said raised surface when said retention assembly is in said unlocked position and said CPA is in said first position.

3. The electrical connector assembly of claim 1 wherein said retention assembly includes a retention member with first and second retention member surfaces, said first retention member surface including said first housing retention feature, said second retention member surface including said CPA retention feature.

4. The electrical connector assembly of claim 1 wherein said retention assembly includes a blocking surface which contacts said CPA and prevents said CPA from being moved from said first position to said second position when said CPA is unbiased, and said second housing retention feature includes a CPA contacting surface that contacts and biases a portion of said CPA such that said CPA may be advanced from said first position to said second position when said first and second connector housings are mated and said CPA is in said first position.

5. The electrical connector assembly of claim 1 wherein said CPA includes a CPA finger rest and said retention assembly includes a retention assembly finger rest, said CPA finger rest at least partially surrounding said retention assembly finger rest when said CPA is in said second position.

6. The electrical connector assembly of claim 1 wherein said CPA includes sides and said CPA mounting assembly is a slot that slidably accepts said CPA sides.

7. The electrical connector assembly of claim 6 wherein said sides include side retention features and said slot includes slot retention features, said side retention features and said slot retention features cooperating to maintain said CPA in said slot.

8. An electrical connector assembly comprising:

a connector position assurance device (CPA) including a said CPA includes a retaining CPA beam and at least one locking CPA beam, a latch locking element extending from said at least one locking CPA beam and a CPA retention element extending from said retaining CPA beam;

a plug housing having a body section with a mating interface on one end thereof;

a header housing having an opening to receive said mating interface;

a latch assembly mounted to said plug housing for maintaining contact between said plug and header housings when mated, said latch assembly including a retention feature, latch arms and a cross-member, said latch arms extending from a latch base and joined by said cross-member proximal to their free ends, said cross-member including a CPA retention feature, and said latch arms including a locking contact surface, said latch assembly being movable between latched and unlatched positions;

a latch retention assembly mounted to said header housing and including a latch retention surface, said latch retention surface cooperating with said retention feature to maintain contact between said plug and header housings when said housings are mated; and a CPA mounting assembly mounted to said plug housing, said CPA being slidably mounted to said CPA mounting assembly and movable to unmated and mated positions, a portion of said latch assembly exposed through a top surface of said plug housing in each of the mated and unmated positions, said CPA permitting movement of said latch assembly to said unlatched position and thereby permitting engagement and disengagement of said plug and header housings when in said unmated position, said latch locking element cooperating with said locking contact surface to prevent said latch assembly from moving to said unlatched position when said CPA is in said mated position, whereby said CPA prevents engagement and disengagement of said plug and header housings when in said mated position, said CPA retention element cooperating with said CPA retention feature to maintain said CPA in said mated position.

9. The electrical connector assembly of claim 8 wherein said latch locking element includes a raised surface, said latch locking element extending from said CPA to said raised surface, and said latch assembly includes an interfering surface and a clearance surface, said interfering surface being substantially parallel to said raised surface when said latch assembly is in said latched position and contacting said raised surface when said latch assembly is biased toward said unlatched position when said CPA is in said mated position, said clearance surface being sloped relative to said raised surface when said latch assembly is in said latched position and not contacting said raised surface when said latch assembly is in said unlatched position and said CPA is in said unmated position.

10. The electrical connector assembly of claim 8 wherein said latch assembly includes a retention member with first and second retention member surfaces, said first retention member surface including said retention feature, said second retention member surface including said CPA retention feature.

11. The electrical connector assembly of claim 8 wherein said latch assembly includes a blocking surface which contacts said CPA and prevents said CPA from being moved from said unmated position to said mated position when said CPA is unbiased, and said header housing includes a CPA contacting surface that contacts and biases a portion of said CPA such that said CPA may be advanced from said unmated position to said mated position when said plug and header housings are mated and said CPA is in said unmated position.

12. The electrical connector assembly of claim 8 wherein said CPA includes sides and said CPA mounting assembly is a slot that slidably accepts said CPA sides.

13. The electrical connector assembly of claim 9 wherein said CPA includes a CPA finger rest and said latch assembly includes a latch assembly finger rest, said CPA finger rest at least partially surrounding said latch assembly finger rest when said CPA is in said mated position.

14. An electrical connector half assembly comprising:

a connector position assurance device (CPA) including a first CPA beam and a second CPA beam, said first beam including retention assembly locking element and said second beam including a CPA retention element;

a connector housing adapted for mating with a mating connector housing;

a retention assembly mounted to said connector housing for securing said connector housing to a mating connector housing when fully mated, said retention assembly including arms, a cross-member joining said arms, and a housing retention feature, said cross-member including a CPA retention feature, and said arms including a locking contact surface, said retention assembly being movable between locked and unlocked positions; and a CPA mounting assembly mounted to said connector housing, said CPA being slidably mounted to said CPA mounting assembly and movable between first and second positions wherein a portion of said latch assembly is exposed, said CPA permitting biasing of said retention assembly when in said first position, said retention assembly locking element underlying said locking contact surface to prevent said retention assembly from moving to said unlocked position when said CPA is in said second position, said CPA retention element cooperating with said CPA retention feature to maintain said CPA in said second position.

15. The electrical connector half assembly of claim 14 wherein said retention assembly locking element includes a raised surface, said retention assembly locking element extending from said CPA to a raised surface, and said retention assembly includes first and second surfaces, said first surface including said locking contact surface, said first surface being located proximal to said raised surface when said CPA is in said second position and contacting said raised surface when said retention assembly is biased toward said unlocked position when said CPA is in said second position, said second surface being located proximal to said raised surface when said CPA is in said first position and not contacting said raised surface when said retention assembly is in said unlocked position and said CPA is in said first position.

* * * * *